US006084499A

United States Patent [19]

Faulk

[11] Patent Number: 6,084,499

[45] Date of Patent: Jul. 4, 2000

[54] PLANAR MAGNETICS WITH SEGREGATED FLUX PATHS

[75] Inventor: Richard A. Faulk, Cypress, Tex.

[73] Assignee: Compaq Computer Corp., Houston, Tex.

[21] Appl. No.: 08/777,847

[22] Filed: Dec. 31, 1996

[51] Int. Cl.[7] ..... H01F 17/06; H01F 21/08; H01F 27/24

[52] U.S. Cl. ..... 336/178; 336/165; 336/212; 336/220

[58] Field of Search ..... 336/178, 165, 336/212, 220, 184

[56] References Cited

U.S. PATENT DOCUMENTS

| | | | |
|---|---|---|---|
| 1,681,573 | 8/1928 | Elmen | 336/200 |
| 4,184,197 | 1/1980 | Cuk et al. | 363/16 |
| 4,186,437 | 1/1980 | Cuk | 363/65 |
| 4,257,087 | 3/1981 | Cuk | 363/16 |
| 4,259,654 | 3/1981 | Persson et al. | 336/212 |
| 4,274,133 | 6/1981 | Cuk et al. | 363/39 |
| 5,023,585 | 6/1991 | Kurano et al. | 336/184 |
| 5,122,947 | 6/1992 | Hishiki | 336/178 |
| 5,313,176 | 5/1994 | Upadhyay | 336/184 |

FOREIGN PATENT DOCUMENTS

| | | | |
|---|---|---|---|
| 2640-076 | 6/1990 | France | 336/220 |
| 4-253308 | 9/1992 | Japan | 336/177 |

OTHER PUBLICATIONS

Dixon, "High Power Factor Preregulator using the SEPIC Converter," 1993 Unitrode Power Supply Design Seminar at p. 6–1 (publication No. SEM–900 from Unitrode).

"New Magnetic Structures for Switching Converters," 3 Advances in Switched–Mode Power Conversion 23 (2.ed. Middlebrook and Ćuk 1983).

"Analysis of Integrated Magnetics to Eliminate Current Ripple in Switching Converters," 3 Advances in Switched–Mode Power Conversion 239 (2.ed. Middlebrook and Ćuk 1983).

"Coupled–Inductor and Integrated Magnetics Techniques in Power Electronics," 3 Advances in Switched–Mode Power Conversion 347 (2.ed.Middlebrook and Ćuk 1983).

Fig. 6–4 of Kaiser, Electrical Power (2.ed.1991).

*Primary Examiner*—Renee S. Luebke
*Assistant Examiner*—Anh Mai
*Attorney, Agent, or Firm*—Robert Groover

[57] ABSTRACT

A planar-type magnetic structure in which two coils, on two poles of the same core, are separated by an open space which is wide enough and low enough that the air return flux, through the open space, completes the flux circuit for each coil. Thus the coupling coefficient between the two coils is very small, even though they are both mounted on a single continuous core of high-permeability material.

38 Claims, 6 Drawing Sheets

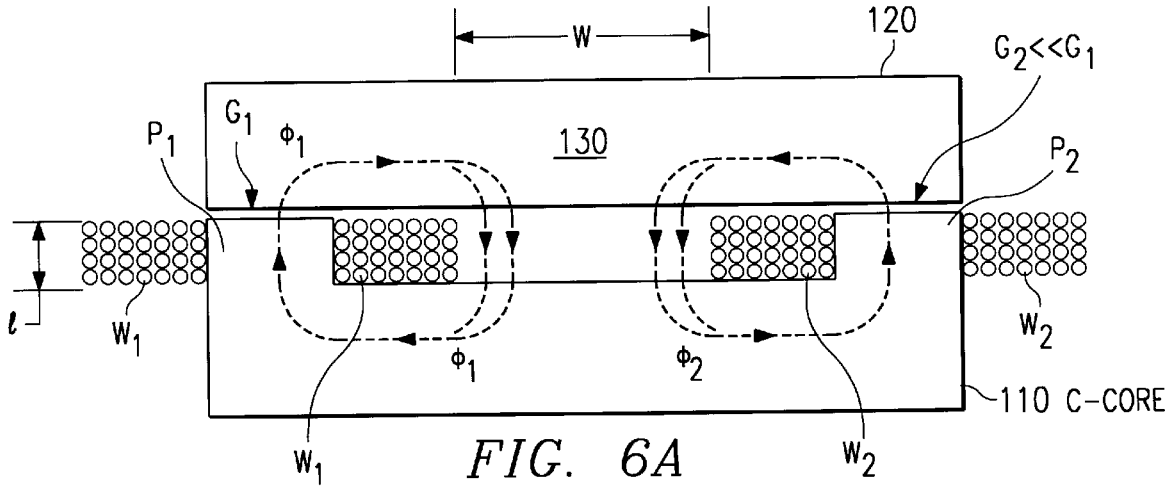
FIG. 6A
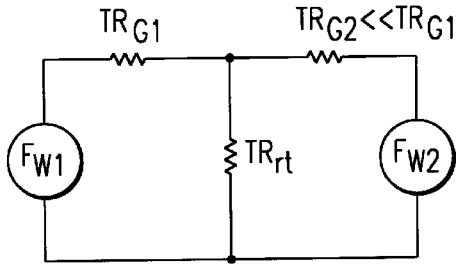
FIG. 6B
FIG. 7
(PRIOR ART)
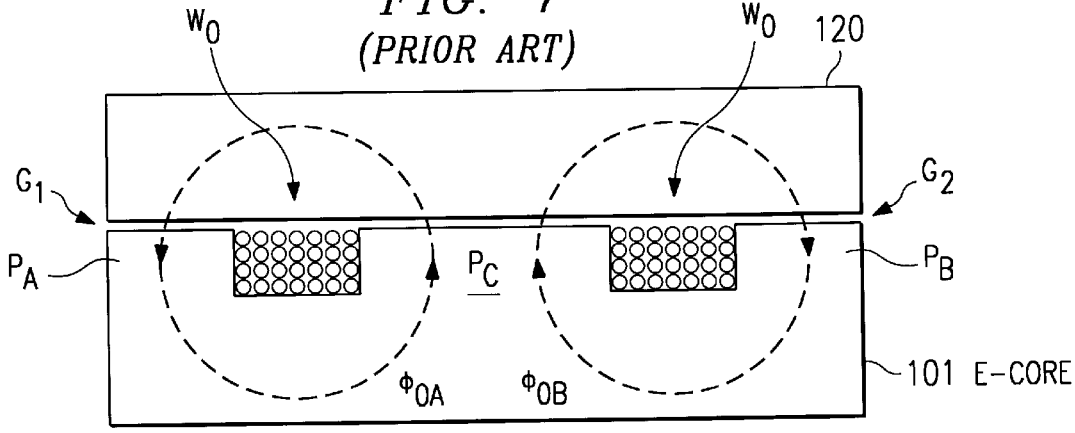

PLANAR MAGNETICS WITH SEGREGATED FLUX PATHS

BACKGROUND AND SUMMARY OF THE INVENTION

The present invention relates to magnetic structures (inductors and transformers) which include flux circuits, and particularly to low-profile (or "planar") inductors and transformers.

Planar magnetic structures are structures of a high-permeability material which have a very low height. This low height make them very convenient for integration on circuit boards or in very small modules.

Conventional analyses of magnetic flux circuit structures often use the simplifying assumptions that a winding is very long (in the direction of its axis), or that the current is distributed in a thin sheet. However, with so called "planar" magnetic structures, the present inventor has realized that these approximations become much less valid, and, moreover, that the conventional design practices for magnetic structures can usefully be rethought in light of planar structures.

Background: Magnetic Circuits

Electromagnetic structures such as chokes and transformers operate by transferring energy from electric current into magnetic flux and back again. In a choke (inductor), a single winding may be used both to pump energy into the magnetic flux during one part of an AC cycle and extract energy from the magnetic flux during another part of the cycle. In a transformer, one coil may be used to pump energy into the magnetic flux while another coil extracts it. However, certain principles of magnetic circuit operation are analogous in either case.

Definitions

It may be useful to review some basics regarding magnetic circuits.

Mmf (F): A winding through which current is flowing generates magnetomotive force, or mmf. (The symbol used to show this is usually F.) Specifically, when a current I is applied through a winding of n turns, the resulting mmf F is equal to n times I. Magnetomotive force F is analogous to voltage (electromotive force) in electric circuits.

Flux ($\phi$): The applied magnetomotive force F will induce a flux in a magnetic circuit. Flux is usually represented by $\phi$, and is analogous to current in an electric circuit.

Permeability ($\mu$): The amount of flux which results from a given amount of applied magnetomotive force F is dependent on the particular material. The constant which relates them, for a given material, is the permeability $\mu$. Permeability of air or vacuum is often written as $\mu_0$, and other materials may have much higher permeabilities. (In particular, ferromagnetic and ferrimagnetic materials, such as iron alloys or ferrites, are commonly used in magnetic structures to provide high permeability to conduct flux to form a magnetic circuit. These materials may have permeability values of several thousand, i.e. several thousand times higher than vacuum.)

Reluctance ($\mathfrak{R}$): In a magnetic circuit, the amount of applied mmf required to achieve a unit of flux flow through the circuit is referred to as the reluctance $\mathfrak{R}$. This is analogous to resistance in electrical circuits.

Magnetic Field Intensity (|H|): Where the mmf F is applied over a length l, the resulting magnetic field intensity |H| is the change in mmf per unit length: |H|=F/l. For example, where a current I flows through a winding of n turns and height l, the resulting field intensity is |H|=nI/l.

Flux Density (|B|): The magnetic field intensity produces a corresponding flux density |B|, which is related to the magnetic field intensity |H| by the permeability $\mu$: B=$\mu$H. Flux density is simply the quantity of flux per unit area, so where flux $\phi$ flows through a cross-sectional area A, B=$\phi$/A. (The absolute value signs have been used for |B| and |H| because B and H are actually both vectors; but for simplicity B and H will be treated as scalar quantities in the following magnetic circuit analysis.)

Inductance (L): The above magnetics parameters determine the low-frequency inductance L of a winding:

$$L = N^2 \frac{H}{\mathcal{R}} = \mu A N^2 \frac{H}{l}.$$

Thus manipulation of these parameters will affect the inductance of a winding, or (in a similar way) will affect the coupling between two windings.

Saturation: The foregoing equations state linear relations, and ignore nonlinear effects. However, in many materials, the permeability is not constant for all values of mmf. At some maximum flux density, the material will "saturate", i.e. further increases in magnetic field will produce no increase in flux. This is conventionally drawn on B/H diagrams which relate applied field intensity to flux density. On such diagrams the flux density can be seen to curve over and flatten out as the maximum flux density is approached.

Hysteresis: It should be noted that some high-permeability materials are "hard," i.e. have a hysteretic effect wherein the material itself becomes magnetized when a large magnetic field is applied. Such materials (which are used for permanent magnets) may still exhibit a significant magnetic flux flow when no external magnetic field is applied. However, "soft" magnetic materials, which have very little hysteresis, are preferred for transformers and chokes. On B/H diagrams hard materials show a wide S-shaped curve, while soft materials show a narrow S-shaped curve; the B/H diagram of an ideally soft material (vacuum) is simply a straight line without width.

Of course, the foregoing analyses relate to low-frequency operation. For sufficiently high frequencies (e.g. VHF or above), the permeability will exhibit frequency dependence. However, this is not relevant to the frequencies (typically well below 1 MHz) which are commonly used in switching power converters.

Further background on magnetostatics and magnetic circuits is given in S. Nasar, ELECTRIC MACHINES AND TRANSFORMERS (1984), especially chapters 1 and 2; Kaiser, Electrical Power (2.ed.1991); and R. Feynman et al., 2 FEYNMAN LECTURES ON PHYSICS (1964), especially chapters 13 through 18. All of these books, and all references cited therein, are hereby incorporated by reference in their entirety.

Background: Cores

In compact low- or medium-power power supplies, magnetic structures are commonly wound on a core which has a cross section like a capital E. (A flat plate of high-permeability material is assembled to the three poles of the E-shaped core, to close the magnetic circuit.) One or more windings are wrapped around the center leg of the E-shaped core, and in the assembled structure the high-permeability material provides a return path for the magnetic flux generated by the winding. Typically one or more windings on the center line of the E apply the mmf to generate flux, and the other legs are simply provide a return path for the flux, to provide a complete magnetic circuit without excessively high reluctance.

To avoid saturation of the core material and resulting undesirable linear effects as discussed above, a small gap is typically left in one part of the magnetic circuit. This gap increases the total reluctance of the circuit, but does provide some protection against any DC imbalance in flux due to any asymmetry in the applied current waveform, and thus provides some ability to resist saturation. The gap is typically of a few mils (e.g. 0.004 to 0.006 inches); depending on the risk of saturation in a particular circuit, more or less gap may be used.

FIG. 7 shows a conventional E-core magnetic structure. A single molded body 101 of high-permeability material has three poles $P_A$, $P_B$, and $P_C$. (The view shown is cross-sectional, but the body has the same cross-section all the way through.) A single winding (or winding stack) $W_0$ is wound around the center pole $P_C$, and the flux generated by this winding $W_0$ recirculates through the lid 120 (which is also molded of the same high-permeability material) and the side poles $P_A$ and $P_B$. The flux generated by winding $W_0$ accordingly separates into two flux paths $\phi_{0A}$ and $\phi_{0B}$, both of which pass through winding $W_0$. Note that the reluctance of each flux path is primarily defined by air gaps $G_1$ and $G_2$ (which are not actually filled with air, but by a polymer film).

Background: Ripple-Free Converter Topologies

One of the important design parameters for switching power supplies is the presence of ripple. Different applications have different degrees of tolerance to voltage fluctuations caused by the active switching which occurs in the power supply itself, and some applications may have very low tolerance for this. Therefore, one of the parameters to be controlled for in at least some converter topologies is the degree of ripple present on the output. Output filters are typically used to reduce ripple, but lower ripple before filtration permits the achievement of either a lowered ripple in the filtered signal or reduction in the size of the discrete components necessary for adequate output filtering.

It is also desirable to reduce ripple on the input to zero. High frequency variation in the input current can propagate into other components, or introduce unacceptable noise coupling pathways into the total system environment.

In most switching power supplies, the switching transistors provide a powerful source of noise at the switching frequency (and its harmonics). However, two families of converter topologies (the SEPIC and Ćuk converter topologies) both exploit current-steering effects to achieve ripple cancellation.

The isolated Ćuk converter provides efficient reduction of ripple currents. This is achieved by using a second transformer (with nk=1, or with n=k), in addition to the main transformer, to provide a ripple-cancelling contribution. Since this topology requires two magnetic elements, the volume and cost of the power supply are increased accordingly. The Ćuk converter is described, for example, in U.S. Pat. Nos. 4,184,197; 4,186,437; 4,257,087; and 4,274,133; all of which are hereby incorporated by reference.

The isolated SEPIC converter topology has been proposed as another approach to ripple cancellation. However, this topology has a difficulty with voltage transients, as noted in Dixon, "High Power Factor Preregulator using the SEPIC Converter," 1993 UNITRODE POWER SUPPLY DESIGN SEMINAR at p. 6-1 (publication number SEM-900 from Unitrode). (This book is hereby incorporated by reference.)

Innovative Magnetic Structures

The present application discloses new magnetic structures, in which separate decoupled windings are wound on separate legs of a single planar magnetic structure; by selecting the dimensions of the magnetics structure appropriately, the separate windings are, surprisingly, almost totally decoupled, even when they are both mounted on a single high-permeability core and there is no air gap along at least one path between the two windings.

This surprising result is due to the reduced reluctance of the air return path which is achieved by appropriate dimensions in planar magnetic structures. The form factors of planar structures have evolved for other reasons, but these form factors have tended to reduce the reluctance of the air return path between the two plates. That is, as the planar magnetic structure is flattened, the total reluctance of an air return path which laterally separates two geometrically parallel windings is reduced: reduced inside height reduces the reluctance, and increased width of this air return path also reduces its reluctance. Accordingly, in the innovative structure most of the flux generated by a winding finds a return path through the open space which is laterally adjacent to the winding. Note that the open space is not a conventional air gap, but is much larger. Moreover, a conventional "air gap" is normally not filled with air, but with a diamagnetic material (such as a thin sheet of fluorocarbon polymer). Thus, a conventional "air gap" is still part of a single solid assembly which includes the high-permeability core. By contrast, the innovative magnetic structures described herein include an open space which is NOT part of the solid core structure.

The magnetomotive force between the two parallel plates of the magnetic structure changes along the length of the plates, due to the flow of flux through the open space. (Even though the plate has high permeability, it is not infinite.) An important part of the magnetic circuit analysis is the gap in the circuit: by ensuring a significant reluctance in the magnetic circuit, it permits a significant flow of flux through the open space. Thus this magnetic circuit is somewhat analogous to an electric circuit in which a pair of conductors is connected to a finite impedance at one end, to a voltage source at the other, and to a distributed resistance in between: the distributed resistance provides a shunt path for current, which reduces current to the impedance.

In the open space next to the winding the vertical separation between the two plates of the magnetic structure will have an applied field H=F/l, so, as the planar structure becomes more planar and the interior height l is reduced, the intensity of H becomes higher for a given applied mmf. The result of this is that the flux density B in the open space will increase (since $B=\mu_0 H$), and thus by increasing the area A of the central open space the flux $\phi_{rt}$ which passes through that gap will increase. When the flux $\phi_{rt}$ through the air return path approximates the entire flux $\mu F$ which is generated by the coil, then the right side of the magnetic circuit can essentially be ignored.

One startling result of this is that a structure can be fabricated which includes two windings with a continuous magnetic path between, and which therefore would look like a transformer, but does not function like a transformer. Instead, the present inventor has experimentally demonstrated structures of this type where the two windings are almost completely decoupled from each other. Thus such a structure can be used merely to provide two independent inductors using a single cast magnetic core. This provides economies of space.

A further advantage is that the maximum power in each winding is limited by the saturation flux of the core cross section. Since the return path in this two-coil structure is an air path, the total power can nearly be doubled, since two independent magnetic circuits are being located in a single structure.

Multi-winding integrated magnetic structures are already known in the literature, but the previously proposed multi-winding structures are not decoupled structures. See, for instance, Ćuk, "New Magnetic Structures for Switching Converters," 3 ADVANCES IN SWITCHED-MODE POWER CONVERSION 23 (2.ed. Middlebrook and Ćuk 1983); Ćuk and Polivka, "Analysis of Integrated Magnetics to Eliminate Current Ripple in Switching Converters, " 3 ADVANCES IN SWITCHED-MODE POWER CONVERSION 239 (2.ed. Middlebrook and Ćuk 1983); Ćuk, "Coupled-Inductor and Integrated Magnetics Techniques in Power Electronics," 3 ADVANCES IN SWITCHED-MODE POWER CONVERSION 347 (2.ed. Middlebrook and Ćuk 1983); all of which are hereby incorporated by reference. However, all of these prior approaches are believe to have intentionally exploited the inductive coupling between different coil and hence to have promoted magnetic structures such that both the magnetic material and the flux path were routed through all the different coils together. By contrast, the current application teaches magnetics structures in which the magnetic material, but not the flux path, is routed through multiple coils.

Power transformer structures which have coils on separate poles of a magnetic structure are well-known: see e.g. FIG. 6-4 of Kaiser, ELECTRICAL POWER (2.ed.1991), all of which is hereby incorporated by reference. However, these conventional magnetic structures are not planar magnetic structures, and (unlike the preferred structures of the present application) are designed to maintain a single flux circuit, and to increase the coupling coefficient between the coils.

In general, the disclosed magnetic structure intentionally uses and increases the air return flux path ($\phi_{rt}$) which is conventionally ignored and/or sought to be minimized in prior structures.

A further surprising feature of planar magnetic structures is that very good couplings (k=0.95) can be achieved by stacking planar coils together on a single leg of the magnetic circuit.

Note that, while the disclosed magnetic structure provides decoupled flux paths, the use of a physically uniform magnetic structure provides greater physical security, so that vibrations are not incurred. Moreover, the flux path provided is a smooth flux path, so that edge effects do not tend to cause local saturation and resulting nonlinearities.

BRIEF DESCRIPTION OF THE DRAWING

The disclosed inventions will be described with reference to the accompanying drawings, which show important sample embodiments of the invention and which are incorporated in the specification hereof by reference, wherein:

The disclosed inventions will be described with reference to the accompanying drawings, which show important sample embodiments of the invention and which are incorporated in the specification hereof by reference, wherein:

FIG. 6A shows an alternative integrated magnetic structure with asymmetrical gapping, and FIG. 6B is a magnetic circuit diagram of the structure of FIG. 6A.

FIG. 7 shows a prior art planar magnetic structure.

DETAILED DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 1:
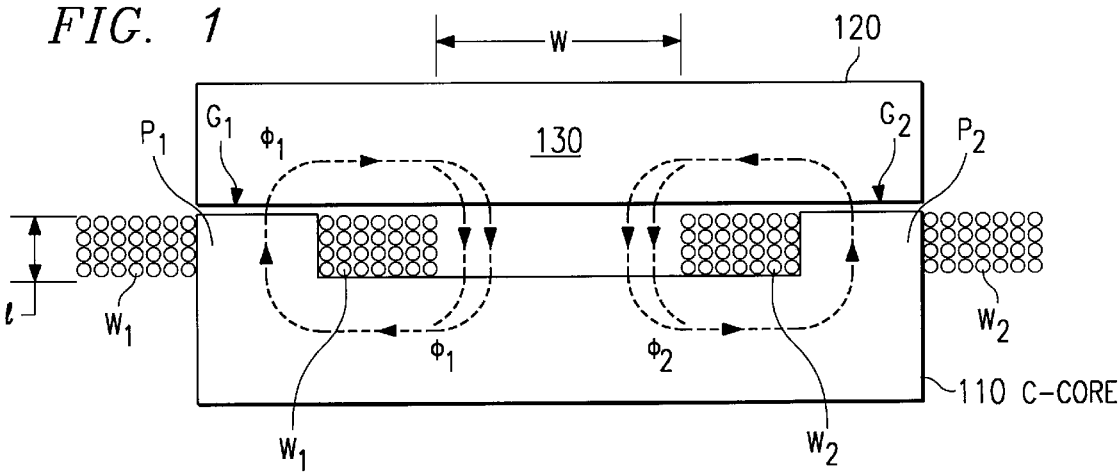
FIG. 1 shows an innovative integrated magnetic structure according to the presently preferred embodiment.

FIG. 1 shows an innovative integrated magnetic structure according to the presently preferred embodiment. This includes a C-shaped core piece 110, and a flat lid 120 which is assembled to the core piece 110. The core piece 110 and lid 120 are both made of high-permeability material, which in a sample embodiment is "P" material from Magnetic Inc. (This material has an initial permeability of approximately 2500.) In the example shown the cross section (in the plane of the page) of both plates, and both poles, is 0.10 inches. The width of the structure (i.e. the front-to-back dimension, which is normal to the page in the orientation illustrated) is 0.50 inches in the presently preferred embodiment. The height of each of the two legs of the 'C' shaped core is 0.2 inches overall. The total assembled height is approximately 0.3 inches.

The air gap of the two legs is defined by a teflon wrap on the planar lid 120, and is about 0.005 inches in the presently preferred embodiment. With this structure, it was experimentally determined that the inductive coupling coefficient k between two 20-turn planar-type coils placed on the two poles was less than 0.1 at 50 kHz.

FIG. 1 shows a sample embodiment of the innovative planar magnetic structure. A single molded C-core body 110 of high-permeability material has only two poles $p_1$ and $p_2$. (The view shown is cross-sectional, but the body 110 has the same cross-section all the way through.) One winding (or winding stack) $W_1$ is wound around pole $p_1$, and the flux generated by this winding $W_1$ recirculates through the lid 120 (which is also molded of the same high-permeability material) and the open space 130. Another winding (or winding stack) $W_2$ is wound around pole $p_2$, and the flux generated by this winding $W_2$ recirculates through the lid 120 (which is also molded of the same high-permeability material) and the open space 130. Note that the two windings $W_1$ and $W_2$ drive separate flux paths $\phi_1$ and $\phi_2$ respectively. The two flux paths both include a significant part of the width w of the open space 130 which laterally separates the two windings $W_1$ and $W_2$. In this embodiment air gaps $G_1$ and $G_2$ (which are not actually filled with air, but by a polymer film) are included in the two poles $p_1$ and $p_2$. Note that the reluctance of the flux paths $\phi_1$ and $\phi_2$ decreases as w is increased, and decreases rapidly as the height l of the open space 130 is decreased. Gap $G_1$ helps prevent flux path $\phi_2$ from being shunted by flux conduction through pole $p_1$, and gap $G_2$ helps prevent flux path $\phi_1$ from being shunted by flux conduction through pole $p_2$.

This structure permits more power to be transferred through a core of a given size. For a flyback application, the continuous power which can be transferred is:

$$P=(V_{in}I\delta)/2$$

where $$\delta=((NV_{out})/(V_{in}+NV_{out})).$$

So for a given $V_{in}$ and $V_{out}$, power is a function of peak current only, i.e. δ does not vary with inductance. So the maximum power is $$Pmax=((V_{in}*\delta)/2)*I_{max}=((V_{in}*\delta)/2)((B_{sat}1)/N\mu)$$

But because the two halves of the C-core are independent (the two halves have effectively independent flux return paths), each does not contribute to the saturation of the other, so $P_c=2*P_e$.

Figure 5A:
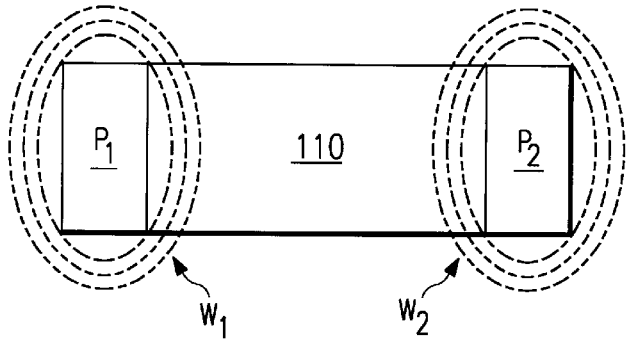
FIG. 5A is a plan view of the magnetic structure of FIG. 1, according to the presently preferred embodiment.

FIG. 5A is a plan view of the magnetic structure of FIG. 1, according to the presently preferred embodiment. In this view the core piece is shown from the side on which the poles are located, and the lid is not shown. Preferably (but not necessarily) the lid 120 has the same outer dimensions as the C-core 110.

Figure 5B:
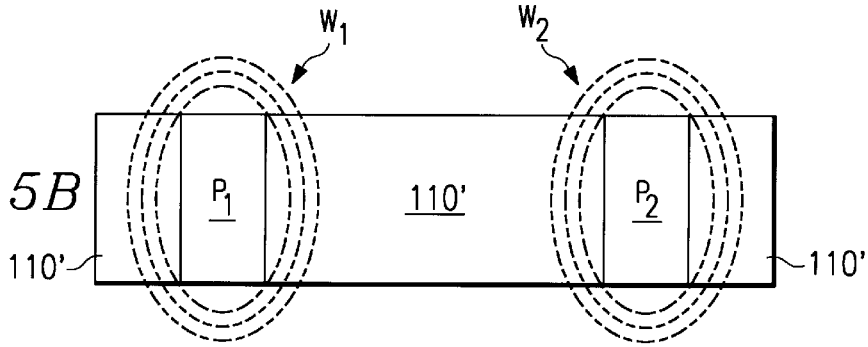
FIG. 5B is a plan view of an alternative embodiment of the magnetic structure of FIG. 1.

FIG. 5B is a plan view of an alternative embodiment of the magnetic structure of FIG. 1. For comparison, the dimensions of the pole pieces and coils may be assumed to be exactly the same in the four embodiments of FIGS. 5A–5D. In this embodiment the modified core 110' extends beyond the poles $p_1$ and $p_2$ in one lateral direction. Preferably (but not necessarily) the lid 120 has the same outer dimensions as the C-core 110'.

Figure 5C:
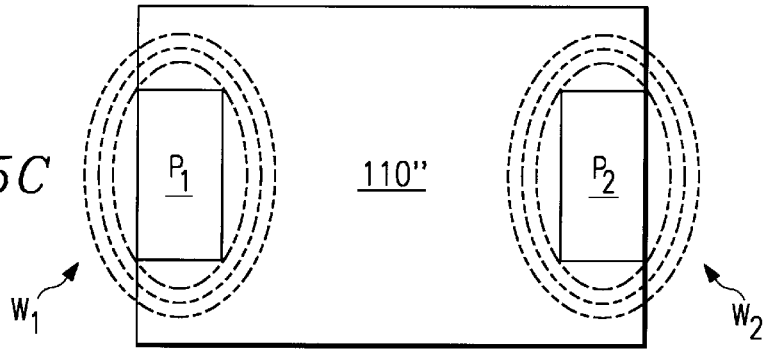
FIG. 5C is a plan view of another alternative embodiment of the magnetic structure of FIG. 1.

FIG. 5C is a plan view of another alternative embodiment of the magnetic structure of FIG. 1. In this embodiment the modified core 110" extends beyond the poles $p_1$ and $p_2$ in one lateral direction (different from that used in FIG. 5B). Preferably (but not necessarily) the lid 120 has the same outer dimensions as the C-core 110".

Figure 5D:
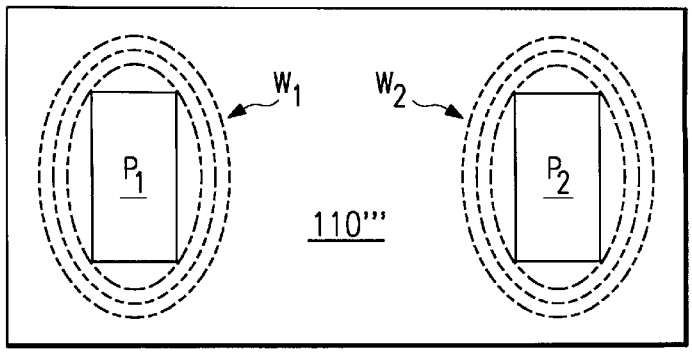
FIG. 5D is a plan view of yet another alternative embodiment of the magnetic structure of FIG. 1.

FIG. 5D is a plan view of yet another alternative embodiment of the magnetic structure of FIG. 1. In this embodiment the modified core 110"' extends beyond the poles $p_1$ and $p_2$ in two lateral directions. Preferably (but not necessarily) the lid 120 has the same outer dimensions as the C-core 110"'.

Asymmetric-Coupling Structures

A further class of alternative embodiments uses asymmetric gapping for the two flux paths. If a "planar" magnetic structure has an air gap $G_1$ atop pole $p_1$ but no gap $G_2$ atop pole $p_2$, then flux generated by a winding $W_2$ on pole $p_2$ will largely be returned through the air return path described above. (More precisely, one gap includes a Teflon spacer, whereas the other gap is typically replaced by a butt joint. A butt joint will add some reluctance, but less than that of an intentionally-added air gap.) Thus an AC signal applied to the winding $W_2$ on pole $p_2$ will not be coupled strongly into the winding $W_1$ on pole $p_1$, i.e. the coupling from $W_2$ to $W_1$ is very weak. By contrast, for flux generated by the winding $W_1$ on pole $p_1$, the air return path is shunted by a lower-reluctance circuit through the magnetic material (passing through pole $p_2$), so this flux will be coupled to winding W2. Thus an AC signal applied to the winding $W_1$ on pole $p_1$ will not be coupled significantly into the winding $W_2$ on pole $p_2$, i.e. the coupling from $W_1$ to $W_2$ is stronger than the coupling from $W_2$ to $W_1$. This asymmetry in coupling can be advantageously exploited in various ways, e.g. for ripple-steering.

FIG. 6A shows an alternative integrated magnetic structure with asymmetrical gapping, and FIG. 6B is a magnetic circuit diagram of the structure of FIG. 6A. This magnetic circuit diagram shows two mmf sources $F_{W1}$ and $F_{W2}$ provided by the two windings W1 and W2), and three reluctances $\mathfrak{R}_{G1}$, $\mathfrak{R}_{G2}$, and $\mathfrak{R}_{rt}$ (provided respectively by gap G1, gap G2, and the air return path 130). In the embodiment of FIG. 1, the magnitude of either gap reluctance $\mathfrak{R}_{G1}$ or $\mathfrak{R}_{G2}$ is typically larger than the magnitude of the reluctance $\mathfrak{R}_{rt}$ of the air return path; however, in the embodiment of FIG. 6A, the gap reluctance of one gap $\mathfrak{R}_{G2}$ is much smaller than the magnitude of the reluctance $\mathfrak{R}_{rt}$ of the air return path. This results in the asymmetric coupling described above.

Alternatively, a lesser degree of asymmetry can be achieved by making one of the gaps $G_1$ and $G_2$ nonzero, but significantly smaller than the other gap.

Power Converter Topologies

The double-circuit integrated magnetic structures make certain circuit topologies more attractive. Several such examples will now be listed, but of course this does not preclude others.

Modified SEPIC-Type Converter

Figure 2A:
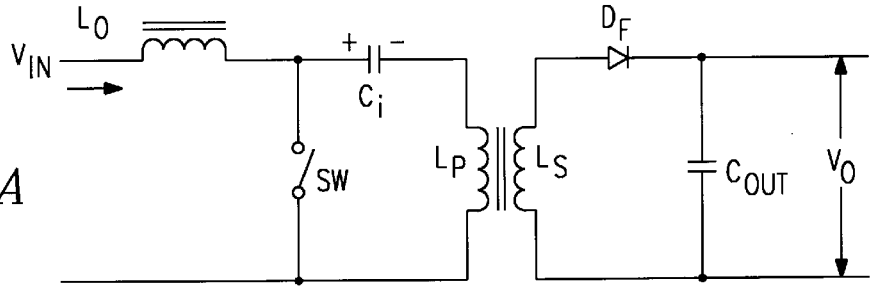
FIG. 2A shows a first sample power converter circuit topology, of the SEPIC type, which is advantageously implemented using the magnetic structure of FIG. 1.

As a first example of use of the magnetic structure of FIG. 1, FIG. 2A shows a SEPIC style converter circuit, in which an input inductor $L_0$ on the input is completely decoupled from the main transformer $L_p/L_s$. A switch SW modulates the current through the input inductor, and a capacitor $C_i$ is interposed between the input inductor and the transformer primary $L_p$. In this circuit the input inductor $L_0$ is preferably placed on one leg $p_1$ of a magnetic structure like that of FIG. 1, and the transformer primary and secondary coils $L_p/L_s$ are both stacked on the second leg $p_2$ of the magnetic structure.

In the structure of FIG. 2A, a conventional output diode $D_F$ and output capacitor $C_{out}$ provide an output voltage $V_0$, which is controlled by the turns ratio between the primary and secondary, and also by the duty cycle of the switch SW. As with other SEPIC-type converters, the structure in FIG. 2A steers ripple from the input side into the transformer primary $L_p$, i.e. no ripple appears on the input voltage $V_{in}$. A normal SEPIC-type converter can use a single magnetic structure, but the use of segregated magnetics provides reduces size for a given power output.

Note that no snubbing circuit is shown in FIG. 2A, and indeed no snubbing circuit is preferably used.

Compact Decoupled-Dual-Transformer Converter

Figure 2B:
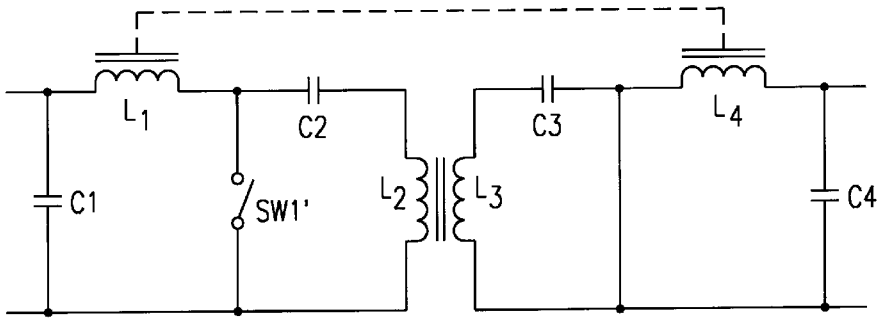
FIG. 2B shows a second sample power converter circuit topology which is advantageously implemented using the magnetic structure of FIG. 1.

Another circuit topology which can be used with the present invention (but which is not as advantageous as the embodiment of FIG. 3A in some respects) is the decoupled-dual-transformer circuit topology shown in FIG. 2B. One transformer is formed by coils $L_2$ and $L_3$, which are tightly coupled together, and the other transformer is formed by coils $L_1$ and $L_4$, which are also tightly coupled together. A capacitor $C_2$ is interposed between windings $L_1$ and $L_2$, and a capacitor $C_3$ is interposed between windings $L_3$ and $L_4$. Switch SW1' modulates the voltage across inductor $L_1$. Capacitors $C_1$ and $C_4$ provide input and output filtering respectively.

This circuit has some resemblance to an isolated Ćuk converter circuit, but has different magnetic connections and operates differently. In an isolated Ćuk converter, both L1 and L4 are magnetically coupled to the L2/L3 pair. (Typically the $L_2$ and $L_3$ coils would be wound on the center leg of an E-core magnetic structure, $L_1$ would be wound on one outer leg of the same E-core magnetic structure, and $L_4$ on the other leg.) See ADVANCES IN SWITCHED-MODE POWER CONVERSION (2.ed. Middlebrook and Ćuk 1983), which is hereby incorporated by reference. Thus a correct circuit diagram of an isolated Ćuk converter would show a magnetic coupling path between the $L_1/L_4$ transformer and the $L_2/L_3$ transformer, but this magnetic coupling path is absent in the circuit of FIG. 2B.

By contrast, the circuit topology of FIG. 2B is implemented with a segregated magnetics structure like that of FIG. 1, and hence the $L_1/L_4$ transformer is decoupled from the $L_2/L_3$ transformer. In one sample implementation the $L_1$ and $L_4$ inductors are tightly coupled together on one pole $p_1$, and the $L_2$ and $L_3$ windings are tightly coupled together on the other pole $p_2$. However, without some degree of coupling between these two pairs, ripple cancellation will not be achieved at both input and output sides. (Ripple reduction can be achieved on one side, but not both.) Thus the topology of FIG. 2B sacrifices some of the advantages of the isolated Ćuk converter, for the sake of reduced size and weight.

In a further alternative embodiment, the height l of the planar structure of FIG. 1 is therefore increased, to increase the reluctance of the return paths $\phi_1$ and $\phi_2$ and introduce some additional coupling between the two transformers of this single magnetic circuit. (Thus this alternative is a hybrid between the circuit of FIG. 2B and an isolated Ćuk converter.) However, this degrades the low form factor and low volume which is preferred for magnetic circuits.

Segregated Flyback Converter

Figure 3A:
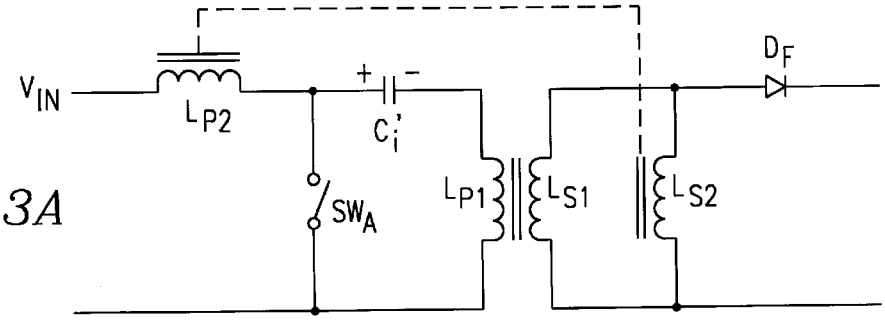
FIG. 3A shows the innovative "segregated flyback" power converter circuit topology, which can advantageously implemented using the magnetic structure of FIG. 1.

Another circuit topology which can use the magnetic structure of FIG. 1 is shown in FIG. 3A. (This topology is also believed to be independently innovative, apart from its use with the magnetic structure of FIG. 1.) This circuit topology uses two transformers with the same turns ratio: tight inductive coupling is provided between an input coil $L_{p1}$ and secondary coil $L_{s1}$. Tight inductive coupling is also provided between another primary coil $L_{p2}$ and another secondary coil $L_{s2}$. However, the $L_{p1}/L_{s1}$, coils are not coupled at all to the $L_{p2}/L_{s2}$ coils. This is preferably accomplished, using the integrated magnetic structure described above, by winding the $L_{p2}$ and $L_{s2}$ coils on one pole of a first flux circuit in a common physical magnetic structure, and winding the $L_{p1}$ and $L_{s1}$ coils, on another pole of the same structure, in a second flux circuit which is separate from the first flux circuit. The turns ratio of the $L_{p1}/L_{s1}$ pair is preferably the same (N:1) as that of the $L_{p2}/L_{s2}$ pair. Switch $SW_A$ is operated to periodically pull one end of the input inductor $L_{p2}$ toward ground. Capacitor $C_i'$ provides coupling to the input winding $L_{p1}$. Note that the two secondaries $L_{s1}$ and $L_{s2}$ are connected in parallel, in front of an output diode $D_F$. This structure can reduce input ripple by steering ripple to the $L_{p1}$ coil. However, maximal power efficiency and density are achieved by operating the two transformers at equal duty cycles, without ripple cancellation.

Figure 3B:
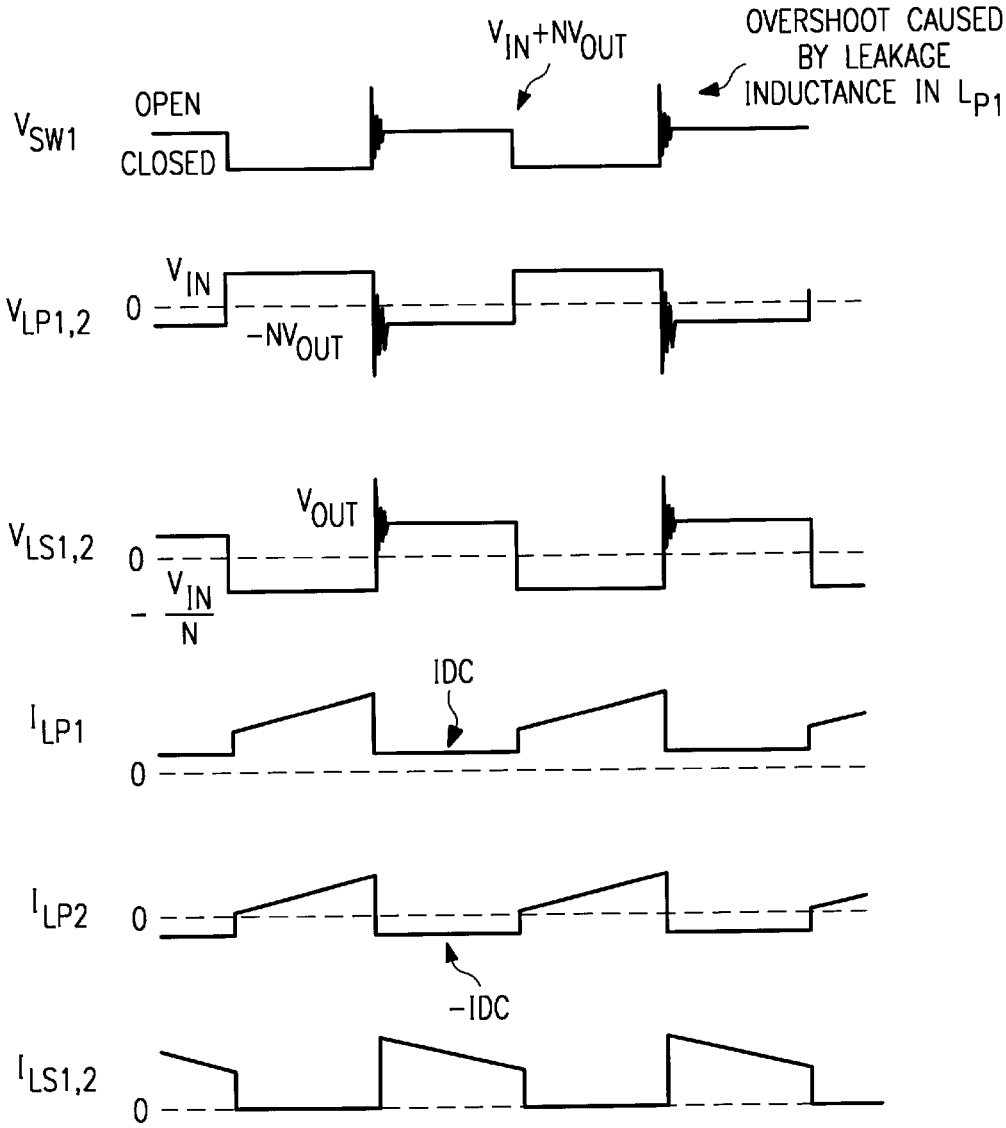
FIG. 3B is a timing diagram which shows the operation of the circuit of FIG. 3A.

FIG. 3B is a timing diagram which shows the operation of the circuit of FIG. 3A. As may be seen from this timing diagram:

When the switch $SW_A$ turns on:

the voltage $V_{SW}$ across the switch goes to zero;

the voltages $L_{LP1}$ and $V_{LP2}$ (on the two primary windings $L_{P1}$ and $L_{P2}$) both jump up to $V_{IN}$;

the voltages $V_{LS1}$ and $V_{LS2}$ (on the two secondary windings $L_{S1}$ and $L_{S2}$) jump down to $V_{IN}/N$;

the current $I_{LP1}$ on the input winding $L_{P1}$ jumps up slightly, and then ramps up steadily;

the current $I_{LP2}$ on the primary winding $L_{P2}$ jumps up slightly (to zero), and then ramps up steadily; and the currents $I_{LS1}$ and $I_{LS2}$ (on the two secondary windings $L_{S1}$ and $L_{S2}$) jump down to zero.

When the switch $SW_A$ turns off:

the voltage $V_{SW}$ across the switch jumps up to $V_{IN}+NV_{out}$ (with some overshoot due to the leakage inductance of $L_{P1}$);

the voltages $V_{LP1}$ and $V_{LP2}$ (on the two primary windings $L_{P1}$ and $L_{P2}$) both jump down to $-NV_{out}$ (with some overshoot);

the voltages $V_{LS1}$ and $V_{LS2}$ (on the two secondary windings $L_{S1}$ and $L_{S2}$) both jump up to $V_{out}$ (with some overshoot);

the current $I_{LP1}$ on the input winding $L_{P1}$ jumps down to a substantially constant value $I_{dc}$;

the current $IL_{P2}$ on the primary winding $LP_2$ jumps down to a substantially constant value $-I_{dc}$;

the currents $I_{LS1}$ and $I_{LS2}$ (on the two secondary windings $L_{S1}$ and $L_{S2}$) jump up, and then ramp down steadily.

Note that the two primaries $L_{P1}$ and $L_{P2}$ preferably transfer equal amounts of energy: the DC current $-I_{dc}$ which flows in $L_{P2}$ while the switch is off reduces the energy transferred into $L_{S2}$, and the DC current $I_{dc}$ which flows in $L_{P1}$ while the switch is off increases the energy transferred into $L_{S1}$, so that the peak current into $L_{S2}$ is equal to the peak current into $L_{S1}$.

Dual-Regenerative Flyback Converter

Figure 4A:
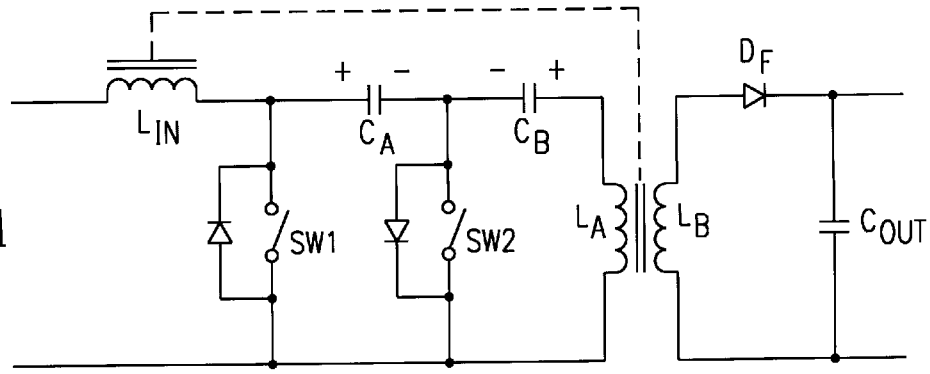
FIG. 4A shows the innovative "dual regenerative flyback" power converter circuit topology, which can advantageously implemented using the magnetic structure of FIG. 1.

FIG. 4A shows a dual regenerative flyback converter circuit. This innovative topology differs from the isolated SEPIC topology in that two switches SW1 and SW2 are used. The use of two switches serves to tightly clamp the transient voltages which, as noted above, would otherwise appear (e.g. in the isolated SEPIC topology).

An input inductor $L_{IN}$ is inductively coupled to a transformer $L_a/L_b$. The turns ratio $L_{IN}:L_a:L_b$ is N:N:1. Switches SW1 and SW2 close alternately; switch SW1 is connected from ground to the + side of capacitor $C_A$, and switch SW2 is connected from ground to the − side of capacitors $C_A$ and $C_B$. The two switches SW1 and SW2 are preferably both power MOS devices of the same size. Note that switch SW1 is connected so that its parasitic diode prevents the + side of capacitor CA from going below the input ground, and switch SW2 (also preferably a VDMOS) is connected so that its parasitic diode prevents the − side of capacitors $C_A$ and $C_B$ from going above the input ground. The energy in $L_a$ can be discharged either to $C_B$ or (through $L_b$) to the output capacitor $C_{out}$. The volt-second balance in $L_{IN}$ maintains the amp-second balance in $C_A$.

Figure 4B:
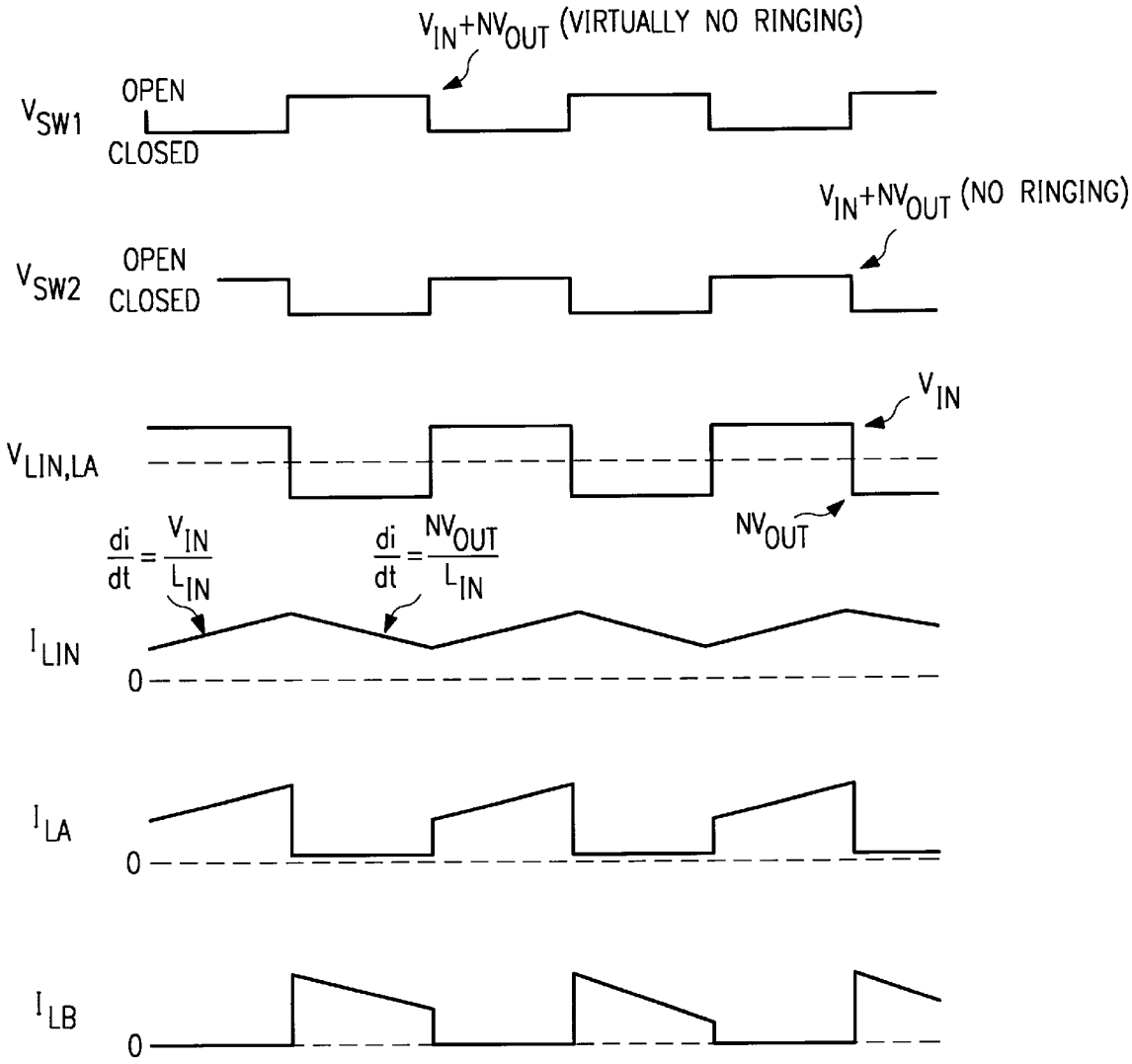
FIG. 4B is a timing diagram which the operation of the circuit of FIG. 4A.

FIG. 4B is a timing diagram which shows the operation of the circuit of FIG. 4A. Note that, in the presently preferred embodiment, switches SW1 and SW2 are operated in strict alternation.

When switch SW2 turns on and SW1 turns off:

the voltage $V_{SW1}$ on switch SW1 jumps up to $V_{IN}+NV_{out}$ (with virtually no ringing), and the voltage on switch SW2 drops to zero;

the voltage $V_{LIN}$ on input inductor $L_{IN}$, and the voltage $V_{La}$ on primary inductor $L_a$, both jump from $V_{IN}$ to a negative value $NV_{out}$;

the current $I_{LIN}$ on input inductor $L_{IN}$ ramps down at a rate of $NV_{out}/L_{IN}$;

the current $I_{La}$ on primary inductor $L_a$ drops to zero;

the current $I_{Lb}$ on secondary inductor $L_b$ jumps up, and then ramps down.

When switch SW1 turns on and SW2 turns off:

the voltage $V_{SW2}$ on switch SW2 jumps up to $V_{IN}+NV_{out}$ (with virtually no ringing), and the voltage $V_{SW1}$ on switch SW1 drops to zero;

the voltage $V_{LIN}$ on input inductor $L_{IN}$, and the voltage $V_{La}$ on primary inductor $L_a$, both jump up to $V_{IN}$;

the current $I_{LIN}$ on input inductor $L_{IN}$ ramps up at a rate of $V_{IN}/L_{IN}$;

the current $I_{La}$ on primary inductor $L_a$ jumps up, and then ramps up; and the current $I_{Lb}$ on secondary inductor $L_b$ drops to zero.

In the example shown the input inductor $L_{IN}$ and transformer windings $L_a/L_b$ are wound on separate flux circuits of a single planar magnetic structure like that of FIG. 1, so that input inductor $L_{IN}$ is not magnetically coupled to the transformer $L_a$/Lb. However, in an alternative embodiment, inductive coupling can be added between the input inductor $L_{IN}$ and the transformer windings $L_a/L_b$, to steer ripple into the primary winding $L_a$ and so minimize input ripple.

Figure 4C:
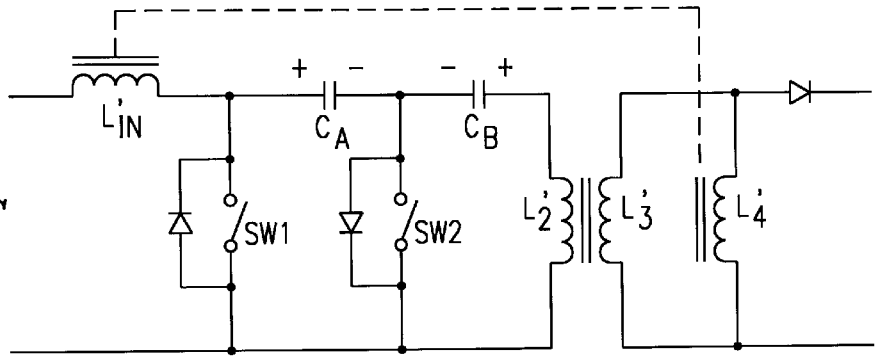
FIG. 4C shows another dual regenerative flyback converter circuit.

FIG. 4C shows another dual regenerative flyback converter circuit. This topology differs from that of FIG. 4A in that the input inductor $L_{IN}'$ is coupled to another inductor $L_4'$ on the output side. This embodiment may be slightly slower than that of FIG. 4A to stabilize at startup, but otherwise retains many advantages. When this circuit topology is (advantageously) implemented with the magnetic structure of FIG. 1, the coils $L_2'$ and $L_3'$ are preferably wound on one pole of the core, and coils $L_{IN}'$ and $L_4'$ are both wound on another pole of the core.

Innovative Portable Computer

Figure 8:
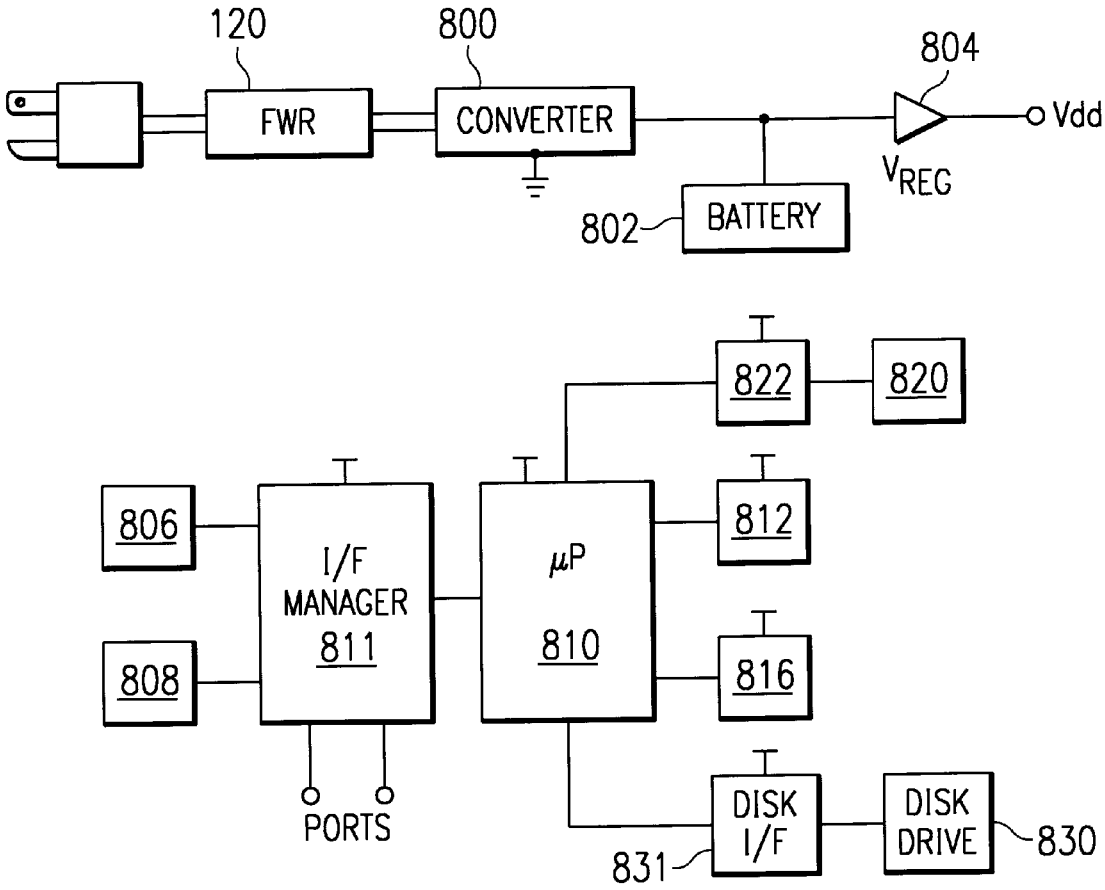
FIG. 8 shows a block diagram of a portable computer system according to the presently preferred embodiment.

FIG. 8 shows a portable computer including a power converter 800 as in FIG. 3A, 4A, or 2A, which is used to charge the battery 802. The power converter is connected, through a full-wave bridge rectifier 120, to draw power from AC mains, and is connected to provide a DC voltage to the battery. The battery 802 (or the converter 800), connected through a voltage regulator 804, is able to power the complete portable computer system, which includes in this example:

user input devices (e.g. keyboard 806 and mouse 808);

at least one microprocessor 810 which is operatively connected to receive inputs from said input device, through an interface manager chip 811 (which also provides an interface to the various ports);

memory (e.g. flash memory 812 and RAM 816), which is accessible by the microprocessor;

a data output device (e.g. display 820 and display driver card 822) which is connected to output data generated by microprocessor; and a magnetic disk drive 830 which is read-write accessible, through an interface unit 831, by the microprocessor 810. Optionally, of course, many other components can be included, and this configuration is not definitive by any means.

According to a disclosed class of innovative embodiments, there is provided an integrated magnetic structure, comprising: first and second magnetic flux circuits in a single structure of high-permeability soft magnetic material; a first winding coupled to apply magnetomotive force to said first flux circuit, and a second winding coupled to apply magnetomotive force to said second flux circuit; said first and second windings each having a greater width than height; wherein more than 80% of the flux of said first flux circuit flows through a first portion of said structure, but never flows through a second portion of said structure regardless of the drive applied to said first winding; wherein more than 80% of the flux of said second flux circuit flows through said second portion of said structure, but never flows through said first portion of said structure regardless of the drive applied to said second winding.

According to another disclosed class of innovative embodiments, there is provided an integrated magnetic structure, comprising: a structure of high-permeability soft magnetic material, including first and second laterally extending pieces, and first and second poles each extending between said first and second laterally extended pieces: at least one first winding wound on said first pole piece; and at least one second winding wound on said second pole piece; wherein said first and second winding have a mutual coupling coefficient therebetween of less than 0.2.

According to another disclosed class of innovative embodiments, there is provided an integrated magnetic structure, comprising: a structure of high-permeability soft magnetic material, including first and second laterally extending pieces, and first and second poles each extending between said first and second laterally extended pieces: at least one first pair of windings wound on said first pole piece; and at least one second pair of windings wound on said second pole piece; wherein every winding of said first pair has a coupling coefficient, to every winding of said second pair, which is less than 0.2; wherein the windings of said first pair have a mutual coupling coefficient therebetween which is greater than 0.90; and wherein the windings of said second pair have a mutual coupling coefficient therebetween which is greater than 0.90.

According to another disclosed class of innovative embodiments, there is provided an integrated magnetic structure, comprising: a structure of high-permeability soft magnetic material, including first and second laterally extending pieces, and first and second poles each extending between said first and second laterally extended pieces: at least one first winding wound on said first pole piece; and at least one second winding wound on said second pole piece; wherein said first and second windings are laterally separated by a distance which is more than four times the height of said pole piece, and said first and second windings each have a greater width than height.

According to another disclosed class of innovative embodiments, there is provided an integrated magnetic structure, comprising: a structure of high-permeability soft magnetic material, including first and second laterally extending pieces, and first and second poles each extending between said first and second laterally extended pieces, and a first gap on one said pole, and a second gap on said second pole: at least one first winding wound on said first pole piece; and at least one second winding wound on said second pole piece; wherein said first and second gaps have dimensions which are related to the height and spacing of said poles, and to the lateral separation between said windings, such that the reluctance of an air return flux path from said first to said second laterally extended piece, in said lateral separation between said windings, is less than the reluctance of said first gap and greater than the reluctance of said second gap.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, in embodiments where the two coils are driven in parallel, the open space can be used to substitute for a conventional air gap. This provides simplified assembly of planar magnetic structures, since it is not necessary to allow for the thickness of the material which defines the air gap. This structure can be applied to transformers as well as chokes, by replicating the coils and their connections on each pole. Note that the polarity of the coil connections should be such that their flux paths are opposed, to ensure that two separate flux loops are created.

In alternative embodiments, the magnetic materials can be shaped to partly bridge the return path. For example, alternatively and less preferably, the middle leg of an "E" core could be shaved down incompletely, to provide a gap in the magnetic circuit (still a much larger gap than a the normal air gap). However, this is less preferable because the added magnetic material reduces the possible lateral spacing of the planar coils. Moreover, a particular advantage of air as a magnetic material is that air (unlike solid materials) does not saturate.

Additional discussion of alternatives and implementation details known to those skilled in the art can be found in the following publications, all of which are hereby incorporated by reference: Pressman, SWITCHING POWER SUPPLY DESIGN (1991); the 3 volumes of Middlebrook and Ćuk, ADVANCES IN SWITCHED-MODE POWER CONVERSION (2.ed.1983); and all of the biennial UNITRODE POWER SUPPLY DESIGN SEMINAR HANDBOOKS; all of which are hereby incorporated by reference. Other references for background in this and related areas include the following: Billings, SWITCHMODE POWER SUPPLY HANDBOOK (1989); Chetty, SWITCHMODE POWER SUPPLY DESIGN (1986); Chryssis, HIGH FREQUENCY SWITCHING POWER SUPPLIES (2.ed. 1989); Flanagan, HANDBOOK OF TRANSFORMER DESIGN & APPLICATIONS (2.ed. 1993); Gottlieb, POWER SUPPLIES, SWITCHING REGULATORS, INVERTERS, AND CONVERTERS (2.ed. 1994); Hoft, SEMICONDUCTOR POWER ELECTRONICS (1986); Lenk, SIMPLIFIED DESIGN OF SWITCHING POWER SUPPLIES (1995); Mazda, POWER ELECTRONICS HANDBOOK (1990); Mohan et al., POWER ELECTRONICS (2.ed. 1995); Nasar, ELECTRIC MACHINES AND TRANSFORMERS (1984); Nave, POWER LINE FILTER DESIGN FOR SWITCHED-MODE POWER SUPPLIES (1991); REACTIVE POWER: BASICS, PROBLEMS AND SOLUTIONS (ed.Sheble 1987); Severns and Bloom, MODERN DC-TO-DC SWITCHMODE POWER CONVERTER CIRCUITS (1984); Shepard, POWER SUPPLIES (1984); Sum, SWITCH MODE POWER CONVERSION (1988); Tihanyi, ELECTROMAGNETIC COMPATIBILITY IN POWER ELECTRONICS (1995); Williams, POWER ELECTRONICS (1987); Wood, SWITCHING POWER CONVERTERS (1981); the proceedings of the annual INTERNATIONAL HIGH-FREQUENCY POWER CONVERSION conferences from 1986 to date; and the proceedings of the POWER-CON and POWER ELECTRONICS SPECIALISTS conferences from 1980 to date. All of these books, and the references cited in them, are hereby incorporated by reference.

What is claimed is:

1. An integrated magnetic structure, comprising:

first and second magnetic flux circuits in a single structure of high-permeability soft magnetic material;

a first winding coupled to apply magnetomotive force to said first flux circuit, and a second winding coupled to apply magnetomotive force to said second flux circuit; said first and second windings each having a greater width than height;

wherein said first flux circuit includes both a first portion of said structure, and also a first air leakage path which shunts flux around a second portion of said structure, and has a reluctance which is less than the reluctance of said second portion of said structure;

wherein said second flux circuit includes both said second portion of said structure, and also a second air leakage path which shunts flux around said first portion of said structure, and has a reluctance which is less than the reluctance of said first portion of said structure.

2. The structure of claim 1, wherein said single structure comprises laterally extended portions which are planar.

3. The structure of claim 1, wherein said single structure comprises poles and laterally extended portions which extend beyond said poles in at least one lateral direction.

4. The structure of claim 1, wherein said single structure comprises poles, and laterally extended portions which extend beyond said poles in at least two lateral directions.

5. The structure of claim 1, wherein said high-permeability soft magnetic material has a relative permeability greater than 2000.

6. The structure of claim 1, wherein said single structure comprises poles, and each said pole is part of a continuous molded body which includes at least one of said laterally extended portions.

7. The structure of claim 1, wherein said single structure comprises poles, and said first and second windings are laterally separated by less than the width of one said pole.

8. An integrated magnetic structure, comprising:

a structure of high-permeability soft magnetic material, including first and second laterally extending pieces, and first and second poles each extending between said first and second laterally extended pieces:

at least one first winding wound on said first pole;

at least one second winding wound on said second pole;

a first air leakage path which provides a shunt reluctance, as seen by flux generated in said first pole, which is less than the reluctance of a flux path extending through said second pole; and a second air leakage path which provides a shunt reluctance, as seen by flux generated in said second pole, which is less than the reluctance of a flux path extending through said first pole;

whereby said air leakage paths decouple said first and second winding, so that said first and second winding have a mutual coupling coefficient therebetween of less than 0.2.

9. The structure of claim 8, wherein said laterally extended portions are planar.

10. The structure of claim 8, wherein said laterally extended portions extend beyond said poles in at least one lateral direction.

11. The structure of claim 8, wherein said laterally extended portions extend beyond said poles in at least two lateral directions.

12. The structure of claim 8, wherein said high-permeability soft magnetic material has a relative permeability greater than 2000.

13. The structure of claim 8, wherein each said pole is part of a continuous molded body which includes at least one of said laterally extended portions.

14. The structure of claim 8, wherein said first and second windings are laterally separated by less than the width of one said pole.

15. An integrated magnetic structure, comprising:

a structure of high-permeability soft magnetic material, including first and second laterally extending pieces, and first and second poles each extending between said first and second laterally extended pieces:

at least one first pair of windings wound on said first pole;

at least one second pair of windings wound on said second pole;

a first air leakage path which provides a shunt reluctance, as seen by flux generated in said first pole, which is less than the reluctance of a flux path extending through said second pole; and a second air leakage path which provides a shunt reluctance, as seen by flux generated in said second pole, which is less than the reluctance of a flux path extending through said first pole;

wherein said air leakage paths decouple said first and second windings, so that every winding of said first pair has a coupling coefficient, to every winding of said second pair, which is less than 0.2; the windings of said first pair have a mutual coupling coefficient therebetween which is greater than 0.90; and the windings of said second pair have a mutual coupling coefficient therebetween which is greater than 0.90.

16. The structure of claim 15, wherein said laterally extended portions are planar.

17. The structure of claim 15, wherein said laterally extended portions extend beyond said poles in at least one lateral direction.

18. The structure of claim 15, wherein said laterally extended portions extend beyond said poles in at least two lateral directions.

19. The structure of claim 15, wherein said high-permeability soft magnetic material has a relative permeability greater than 2000.

20. The structure of claim 15, wherein each said pole is part of a continuous molded body which includes at least one of said laterally extended portions.

21. The structure of claim 15, wherein said first and second windings are laterally separated by less than the width of one said pole.

22. An integrated magnetic structure, comprising:

a structure of high-permeability soft magnetic material, including first and second laterally extending pieces, and first and second poles each extending between said first and second laterally extended pieces:

at least one first winding wound on said first pole;

at least one second winding wound on said second pole;

a first air leakage path which provides a shunt reluctance, as seen by flux generated in said first pole, which is less than the reluctance of a flux path extending through said second pole; and a second air leakage path which provides a shunt reluctance, as seen by flux generated in said second pole, which is less than the reluctance of a flux path extending through said first pole;

wherein said first and second windings are laterally separated by a distance which is more than four times the height of said pole, and said first and second windings each have a greater width than height.

23. The structure of claim 22, wherein said laterally extended portions are planar.

24. The structure of claim 22, wherein said laterally extended portions extend beyond said poles in at least one lateral direction.

25. The structure of claim 22, wherein said laterally extended portions extend beyond said poles in at least two lateral directions.

26. The structure of claim 22, wherein said high-permeability soft magnetic material has a relative permeability greater than 2000.

27. The structure of claim 22, wherein each said pole is part of a continuous molded body which includes at least one of said laterally extended portions.

28. The structure of claim 22, wherein said first and second windings are laterally separated by less than the width of one said pole.

29. An integrated magnetic structure, comprising:

a structure of high-permeability soft magnetic material, including first and second laterally extending pieces, and first and second poles each extending between said first and second laterally extended pieces, and a first gap on one said pole, and a second gap on said second pole:

at least one first winding wound on said first pole; and at least one second winding wound on said second pole;

wherein said first and second gaps have dimensions which are related to the height and spacing of said poles, and to the lateral separation between said windings, such that the reluctance of an air return flux path from said first to said second laterally extended piece, in said lateral separation between said windings, is less than the reluctance of said first gap and greater than the reluctance of said second gap.

30. The structure of claim 29, wherein said second gap has a reluctance of approximately zero.

31. The structure of claim 29, wherein said first gap has a thickness of approximately 0.005 inches.

32. The structure of claim 29, wherein said first and second windings are laterally separated by a distance which is more than four times the height of said pole, and each have a greater width than height.

33. The structure of claim 29, wherein said laterally extended portions are planar.

34. The structure of claim 29, wherein said laterally extended portions extend beyond said poles in at least one lateral direction.

35. The structure of claim 29, wherein said laterally extended portions extend beyond said poles in at least two lateral directions.

36. The structure of claim 29, wherein said high-permeability soft magnetic material has a relative permeability greater than 2000.

37. The structure of claim 29, wherein each said pole is part of a continuous molded body which includes at least one of said laterally extended portions.

38. The structure of claim 29, wherein said first and second windings are laterally separated by less than the width of one said pole.

* * * * *